US005995003A

United States Patent [19]

Rogers

[11] Patent Number: 5,995,003

[45] Date of Patent: Nov. 30, 1999

[54] ELECTRONIC PIN FASTENER

[76] Inventor: Robert Rogers, 54 Jackson's Point Ave., Jackson's Point, Canada, L0E 1L0

[21] Appl. No.: 09/011,173

[22] PCT Filed: Jul. 31, 1996

[86] PCT No.: PCT/CA96/00517

§ 371 Date: Feb. 2, 1998

§ 102(e) Date: Feb. 2, 1998

[87] PCT Pub. No.: WO97/05585

PCT Pub. Date: Feb. 13, 1997

[51] Int. Cl.[6] ..... G08B 13/14

[52] U.S. Cl. ..... 340/568.4; 340/568.1; 340/568.2; 340/572.1; 340/572.9; 340/652

[58] Field of Search ..... 340/568.1, 568.2, 340/568.4, 572.1, 572.9, 652

[56] References Cited

U.S. PATENT DOCUMENTS

| | | | |
|---|---|---|---|
| 4,598,827 | 7/1986 | Keifer | 211/4 |
| 4,620,182 | 10/1986 | Keifer | 340/568.2 |
| 4,746,909 | 5/1988 | Israel et al. | 340/568.2 |
| 5,019,801 | 5/1991 | Anderson, III | 340/522 |
| 5,066,942 | 11/1991 | Matsuo | 340/568.2 |
| 5,172,098 | 12/1992 | Leyden et al. | 340/568.2 |
| 5,345,219 | 9/1994 | Rogers | 340/568.2 |
| 5,345,220 | 9/1994 | Wachsman | 340/568.4 |
| 5,604,484 | 2/1997 | Rogers | 340/652 |

*Primary Examiner*—Glen Swann

[57] ABSTRACT

An electronic pin fastener (29) for use in a security system for garments, merchandise, and the like mounted for sale or display on a display fixture, rack, or bin causes an alarm to be produced upon removal of the pin fastener (29). The pin fastener (29) has an enclosed housing (60) having top (68) and bottom (63) walls, a hole centrally disposed in the bottom wall (63), a pin (61) having a head and a stem, the stem extending through the hole in the bottom wall (63), and bias means effective to bias the head of the pin (61) towards a predetermined position such as to cause an alarm. The stem of the pin (61) is retained in a depressed position such as to not produce an alarm by an EAS tag or locking device after the pin (61) is inserted through a garment.

6 Claims, 11 Drawing Sheets

10
15
19
25
50
29
27
41
47
23
37
21
17
9
13

ELECTRONIC PIN FASTENER

BACKGROUND OF THE INVENTION

The present invention relates to mechanical security systems particularly adapted for providing protection against shoplifting of merchandise such as garments displayed on garment fixtures, bins or racks. More particularly, the present invention provides a mechanical fastening system for use with electronic security devices which is of complex as well as comparatively simplified construction and is characterized by novel features of construction and arrangement providing versatile adaptation to existing furnishings, systems and store fixtures in garment display section of stores while providing maximum accessibility to individual items of merchandise or apparel displayed on racks, bins or fixtures.

Clothing sales are primarily made by displaying the garment on open racks such that customers may put on the clothing to determine proper fit and may view themselves in the clothing to determine the appropriate aesthetic appeal. However, high risk items such as suits, high end fashions and coats or other outerwear garments have a relatively high value, and concern for security is important. Accordingly, efforts have been made to reduce the likelihood of theft or other unauthorized removal of the merchandise or garments from the store.

Security devices for merchandise and garments are, of course, not new per se. A number of systems have been proposed which allow the potential customer to inspect the items on display racks, bins or fixtures without setting off an alarm and at the same time preventing the removal of the item from the premises or immediate vicinity of the display. A typical low end system involves the step of threading a single steel cable through all the garments on a particular rack, such that the ends of the cable are secured by a manual key locking mechanism to the rack. This system has obvious drawbacks due to potential cutting of the cable without sounding an alarm as well as the inaccessibility of the garments to the customer for fitting without assistance nor are they capable of being purchased until such cable is removed by a staff member. That is not convenient, even if the desired garment is close to the end of the cable. Particularly with jackets and coats, such a removal and reinsertion process for the steel cable is both time consuming and not conducive to what are called impulse sales.

Attaching an individual cable to each garment is a known way to resolve the difficulties of collective security attachment. It is desirable that a customer be able to select a number of garments, and reach the point of decision to purchase a particular item. One system which has been found to be effective for both security and display of clothing is described in U.S. Pat. No. 4,598,827. This system includes a housing in which a plurality of cables are employed, with each cable being attached at one end to the garment and at the other end to the housing. The attachment to the housing is detachable, such that any one or individual cables can be removed or attached to the housing without disturbing the other cable attachments. However, this system still does not deter the cutting of the cable without alarm or tampering due to the duplication of keys for the housing.

One method of attaching the cable to the garment is shown in the above patent, where a cable is passed through an opening such as a buttonhole in the garment, where the cable has an enlarged plastic button at one end to prevent that end from passing through the opening. The other end of the cable is then attached to the security monitoring housing.

The problem with this system, which has been effective up to a point, is that the security housing is attached to a stanchion of the supporting rack by suitable bolts or screw-type fasteners, thereby exposing the security system to direct tampering due to forceful entry or duplication of keys. Also, the cable shown in this patent is not secure against cutting, and would not send an alarm if cut and removed from the garment.

Another system of garment security and protection is shown in U.S. Pat. No. 4,620,1.82. In this system, an alarm mechanism is employed for signaling a closed circuit condition, such as when the cable which mechanically connects the retail item to the security device is cut. This system has been found to be effective in securing garment which have been displayed on a rack, bin or other store fixture by attaching to the merchandise or garment as in the prior patent discussed above and to the housing by plugging the other end of the cable into a jack or other electrically connecting fixture.

In this system, the cable is also sensitive to being cut and will sound an alarm via the disclosed electronic circuitry when, for example a pair of conductive elements are contained in the cable and complete a circuit when joined together by actions such as cutting of the cable. The system is very effective in some situations, but concern for having exposed ports for attachment of the cable still exists. It is possible for clever shoplifters to tamper with the cable ports, such as by insertion of an element into the port to keep the system in steady state even when the cable is cut. Since the system operates on battery, and since it is in a normally open circuit condition, jamming an object into the port might be possible, whereby the circuit would not be completed upon removal of the jack from the port.

U.S. Pat. No. 5,345,220 discloses a security clip consisting of a pair of opposing jaws pivotally mounted on the clip in a normally closed position. The clip also includes a switch for activating the alarm upon placement of a garment in the jaws of the clip. whereby removal of the garment causes the switch to trigger the alarm.

None of the prior art systems provide for complete security, particularly for the attachment of the cable to the security housing. This has been found to be the point where the security system is most likely to fail, either from inattentive or careless use by the sales personnel. For example, if the jack is not properly inserted into the plus when the garment is placed in the system, it may be removable without alarming the system because it has not been placed fully into the system. Alternative, failure to lock the unit because of neglect or because the sales person is trying to show several customers several garments at the same time will permit unauthorized removal of additional garments by someone in the midst of the confusion and focused attention on others. It is of prime importance that the connection to the alarm box or security monitoring/alarm sending unit not be disturbed each time one garment is removed from the system such as when one garment has been sold. Also, if cables are improperly attached and the manufacturer's codes are not adhered to, this can cause an aesthetic problem from tangling, due to multiple handling, as well as a safety problem due to the improper positioning of the cables.

Other more sophisticated equipment in the market place is referred to as Electronic Article Surveillance (EAS). These systems Generally consist of a self energized tag for each garment or merchandise, which are attached by a steel pin through the garment or merchandise into the tag. On payment for the merchandise the tag would be removed or desensitized. A receiver would then be located at each exit door way or department exit to generate an alarm if the merchandise was removed without payment. This type of system allows for more freedom of movement and impulse buying within a designated area. Another type of EAS security tag is shown in International Publication WO 91/13416. The security tag consists of a housing containing a battery and radio frequency transmitter. The security tag is attached to the garment by a tack. Unauthorized removal of the tack causes a cam element within the housing to trip a switch resulting in the tag transmitting a radio frequency which is detected by a remote receiver which activates an alarm. The downfalls to all of these systems have been the cutting of the pin creating no alarm and disabling the tag from the merchandise or garment prior to the item reaching an exit. It has also been recorded that proper pin removal tools normally used by staff have turned up in the general population, creating a potential risk factor. Other factors creating minor downfalls to these systems are detuning of the tags, receiver false alarms which generate mistrust in the operators of the systems and general confusion of staff when more than one party exits the area simultaneously. In general, these systems have done an adequate job on general merchandising but have left high risk items relatively unprotected.

SUMMARY OF THE INVENTION

Accordingly, it is an object of the present invention to provide a security system for garments or merchandise which allows for access to each individual item on the display rack, bin or fixture.

Another object of this invention is to provide a system in which individual cables are attached to the garment at one end and are secured to the security system at the other end of the cable in such a manner as to prevent access to the junction of the cable system.

Yet another object of the present invention is to provide a system in which the cable and security housing connection is not capable of being disabled by preventing access to the connection in a normal operating condition.

Still another object of the present invention is to provide a backup safety connection between the electronics of the security housing and the cable so that inadvertent or intentional disabling of the first connection will not prevent the second connection from serving as a security monitor and alarm system.

Still another object of the present invention is that it is capable of providing a secondary backup system after removal from the primary system by incorporating and working in conjunction with existing EAS technology.

Still another object of the present invention is that any tampering to it or the EAS tag would create an alarm situation.

Still another object of the present invention is to eliminate unsightly esthetics by utilizing the merchandise or garments to conceal, as much as possible, the security components.

Still another object of the present invention is to permit potential customer handling of garments and merchandise on the primary system, maintaining maximum security, with minimal staff interaction.

Still another object of the present invention is to have universal attachments that will make use of already existing fixtures without disposal of any part of the existing fixtures.

Still another object of the present invention is to eliminate some of the downfalls due to duplication or loss of keys of a keyed on/off alarm unit.

Thus, in accordance with the present invention, there is provided an electronic pin fastener for use in a security system for garments, merchandise and the like mounted for sale or display on a display fixture, rack or bin, whereby removal of the pin fastener will cause an alarm. The pin fastener comprises an enclosed housing having top and bottom walls, a hole centrally disposed in said bottom wall, a pin having a head and a stem, the stem of the pin extending through said hole in said bottom wall and bias means adapted so that the head of said pin is biased towards a circuit closed or open position to cause an alarm. The stem of the pin is adapted to be retained in a depressed non-alarm position by a locking device, preferably having a spring release action or a clutch release such as an EAS tag, after the pin is inserted through a garment.

The present invention also includes a security system for use with garments, merchandise and the like mounted for display on a display fixture, bin or rack to provide an alarm upon breach of the primary security conditions, with a potential of a secondary backup system. The system includes one or more electronic pin fasteners adapted to be connected to a garment, merchandise or the like by a locking devise such as an EAS tag or the like. One or more garment pin cables have one end to be adapted for attachment to the electronic pin fastener and the other end adapted to be connected to cable connector and through that connector to an alarm cable which in turn is connected to an alarm box complete the system. The alarm box is preferably mounted at a location proximate to a display fixture, rack or bin, such as on the vertical section of a coat rack or the like. The alarm box may be provided with a two setting switch for instant or delayed alarming of an alarm contained in the box. The alarm box is adapted to sound the alarm when security conditions are breached or tampering occurs. Security conditions include any intrusion into the integrity of the alarm box itself as well as cutting or unauthorized removal of the garment pin cable or EAS tag or locking device, as well as other damage to any of the cables in the system or to the connector. The alarm box preferably includes an end user selected digital setting code for accessing and operating the system.

The garment pin cables connect individual garment/merchandise to the system by use of plugs and jacks. The garment pin cables have an electronic pin fastener located at one end. A pin which can be connected to existing or new EAS tags or locking devices having preferably either a spring release action or a clutch release normally released by magnetic pull extends out of the pin fastener. The electronic pin fastener's pin is inserted through the garment or merchandise and then attached with a tag or locking device to securing of the pin fastener to the garment/merchandise therefore preventing unauthorized removal.

The universal cable connector is adapted to connect the plurality of garment pin cables to a universal connection using jack ports for receiving plugs which have been provided at the end of each of the garment pin cables remote from the pin fastener. These plug and jack connections make a connection between the cable and the connector which permits the transmission of a security breach signal to the alarm box The universal cable connector is fastened to a garment/merchandise display fixture, rack or bin by any suitable means such as the adjustable clamp/bracket of the present invention.

It is desirable to protect the ease of use of the universal cable connector by using a closed circuit technology avoiding the use of an open circuit shunt plug commonly used if the port or jack is not in use. This will eliminate problems encountered by the loss of the shunt plug, due to improper storage, therefore causing the possibility of a non functioning system.

Finally, the system has at least one or more alarm cables connecting the alarm box and the universal cable connector to complete an alarm circuit. The alarm circuit is operable to activate the alarm upon breach of security conditions, unauthorized removal of any one of the garment pin cables, the alarm cable or the alarm box.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DESCRIPTION OF THE PREFERRED EMBODIMENTS

Figure 1:
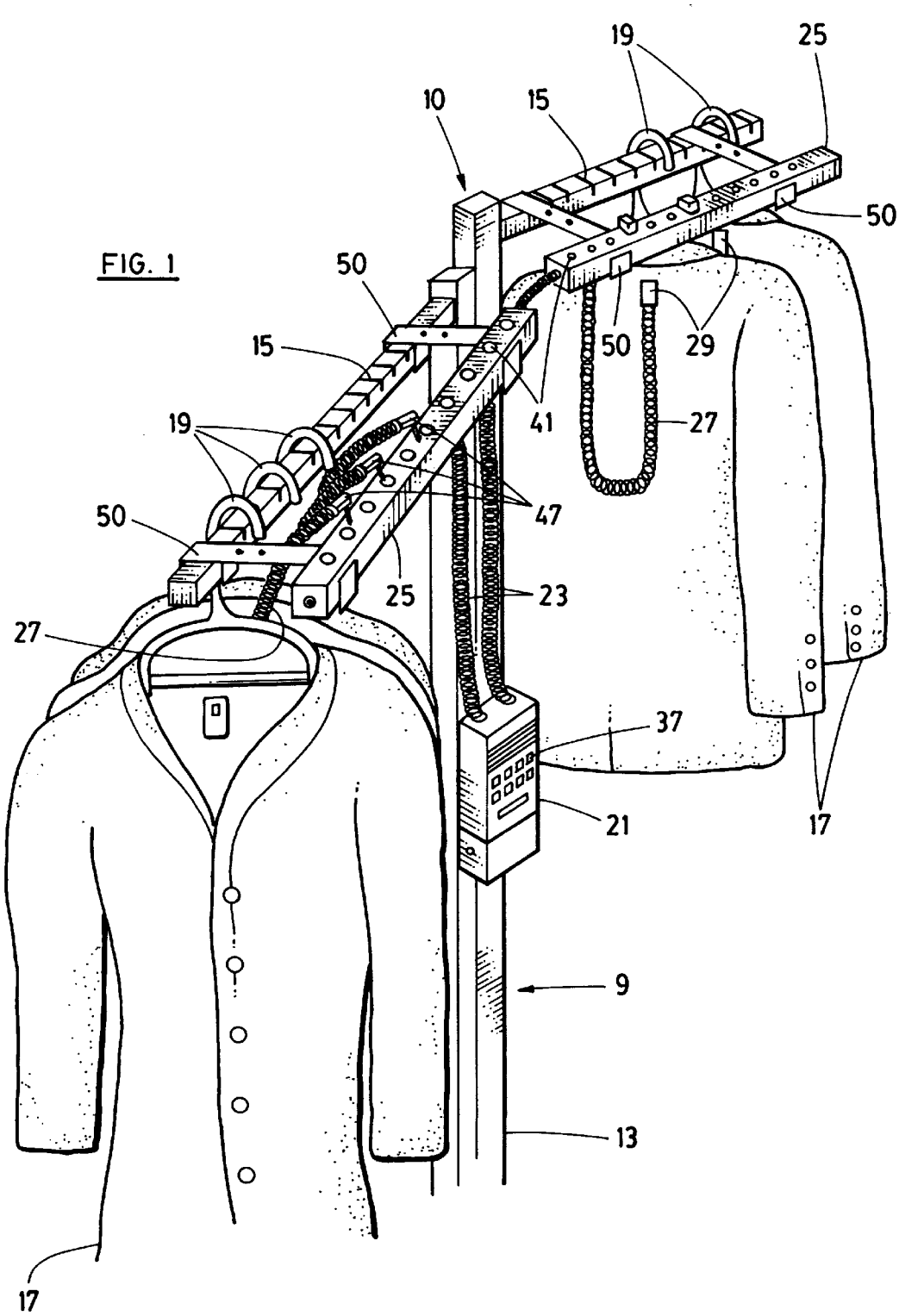
FIG. 1 is a perspective view of a security system in accordance with the present invention mounted on a display fixture.
Figure 6:
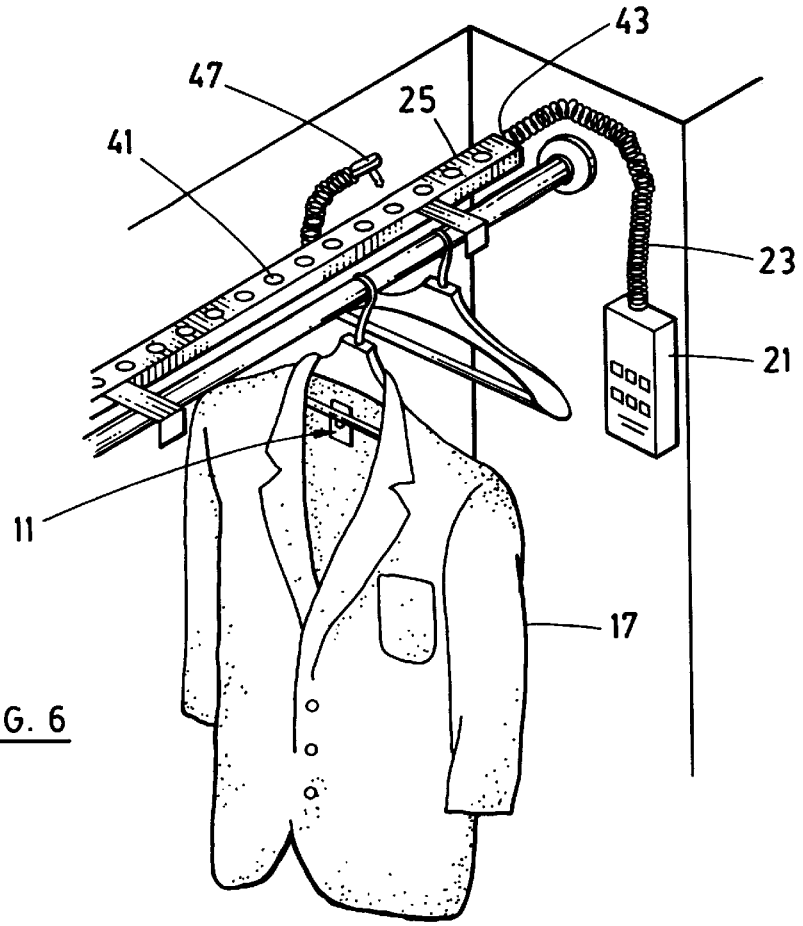
FIG. 6 shows the system of the present invention use in connection with another type of garment display.

As shown in FIG. 1, a security system, generally indicated at 10, is intended for use with a clothing rack 9 or other display fixtures. This rack 9 includes a vertical portion 13 which extends up to a horizontal member 15 which is disposed to hold garments 17 which have been hung on hangers 19. It is to be understood that any display fixture can be used in combination with the present invention and such is the intention herein. An alternative display fixture is illustrated in FIG. 6.

Figure 2:
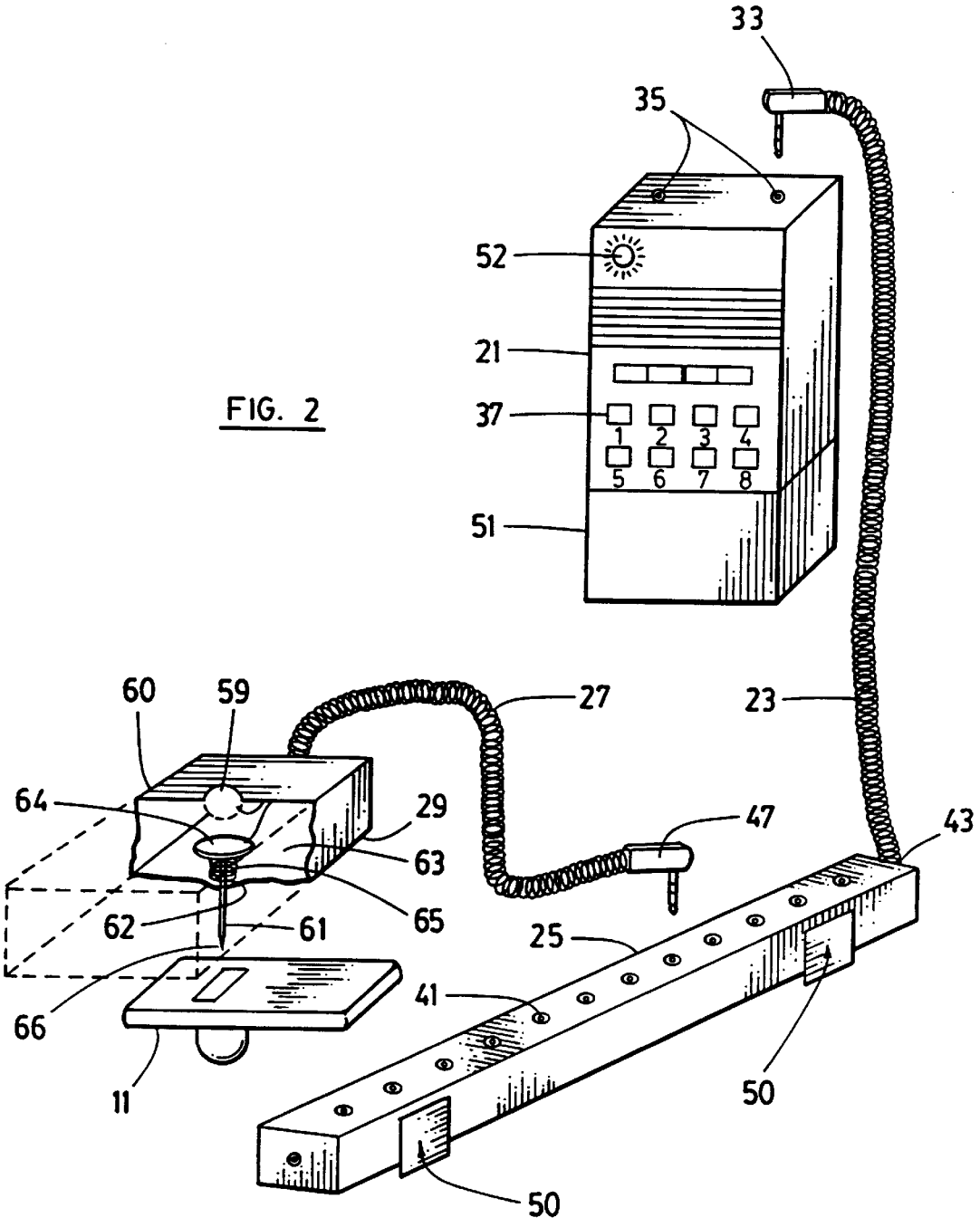
FIG. 2 is an enlarged view of an alarm box, universal cable connector and garment pin cable of the system of FIG. 1 with the electronic pin fastener shown in partial cross section.
Figure 5:
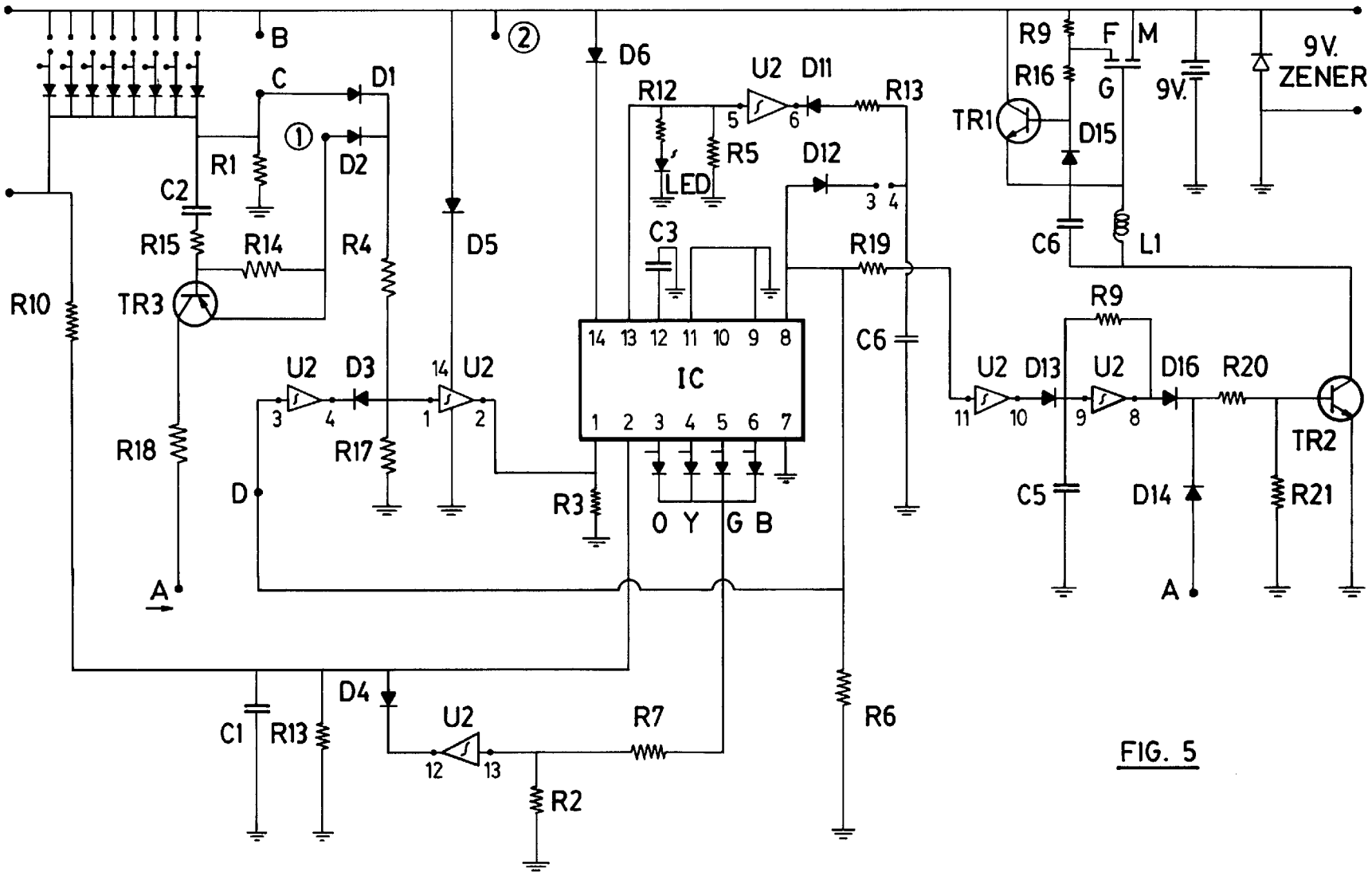
FIG. 5 is a schematic of a circuit diagram for a digital access code alarm box of the present invention.
Figure 8:
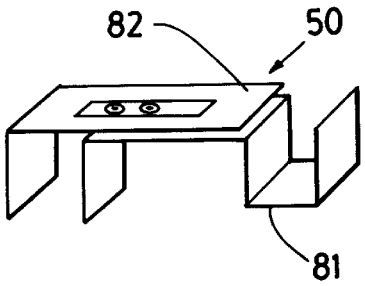
FIG. 8 illustrates an adjustable clamp/bracket for attachment of the universal cable connector of the present invention to a display rack.
Figure 9:
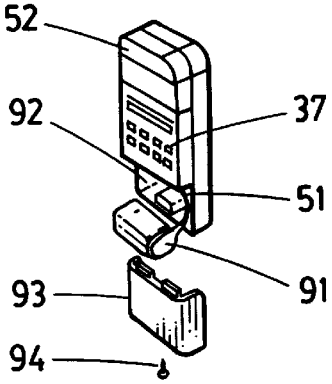
FIG. 9 is a perspective view of the alarm box of the present invention.

The security system 10 of this invention includes an alarm box 21, which may be mounted by any suitable means such as heavy duty self adhesive, Velcro or mechanical fasteners, on vertical section 13 of the clothes rack 9. The alarm box can be mounted at any convenient location and is shown attached to vertical section 13 by way of example. As shown in FIG. 9 the alarm box can be powered either from an electrical outlet or where an outlet is not available by a 9 volt battery 91 (FIG. 9). The battery can be mounted in a battery compartment 92 enclosed by plate 93 which is retained in place by screws 94. The alarm box 21 is preferably a digital alarm that can be programmed by the end user with a time delay feature before the alarm sounds and an access code to permit removal of a garment from the system by the sales clerk without activating the alarm. A circuit diagram for a digital access alarm is illustrated in FIG. 5 as an example of the circuitry that can be utilized. Extending from the alarm box 21 is at least one or more alarm cables 23 which are, as best shown in FIG. 2, attached to alarm box 21 by insertion of plug 33 into jack 35. Alarm cable 23 is connected to universal cable connector 25. The cable connector 25 may be connected to the display rack by means of the adjustable bracket 50, shown in detail in FIG. 8. Also connected to universal cable connector 25 are a plurality of garment pin cables 27. Garment pin cables 27 are connected to garments 17 by a electronic pin fastener 29 and cooperates with an EAS tag or locking mechanism 11.

Figure 3:
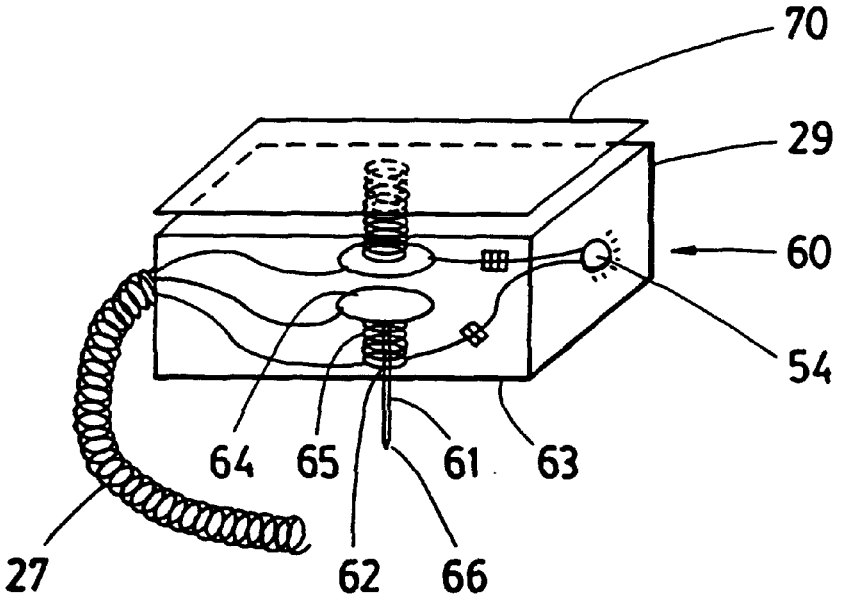
FIG. 3 is a schematic view showing the interior circuitry of an electronic pin fastener of the present invention having a plunger activation mechanism.
Figure 4:
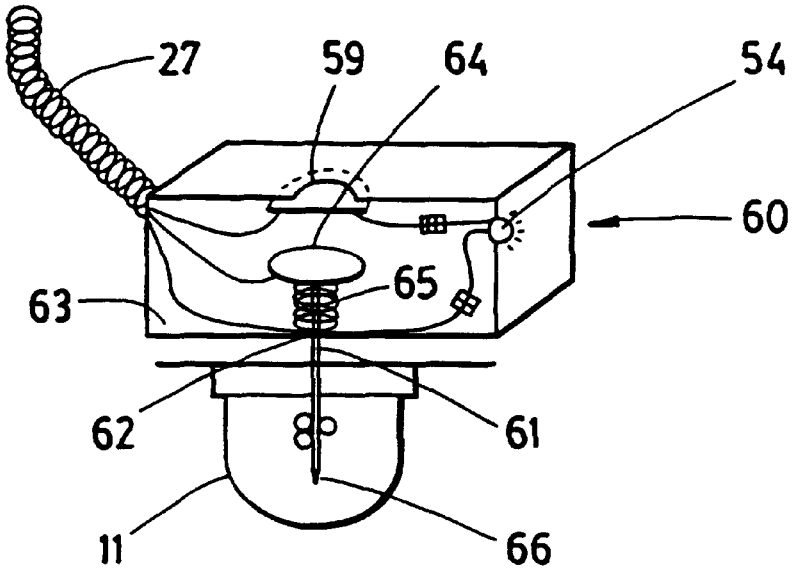
FIG. 4 is a schematic view showing the interior circuitry of another embodiment of the electronic pin fastener of the present invention having a mechanical activation mechanism.
Figure 7:
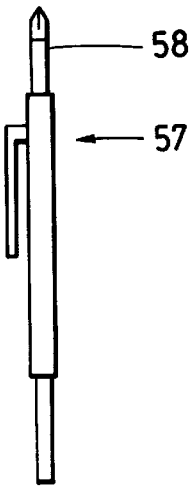
FIG. 7 illustrates a pin setting tool of the present invention.
Figure 10:
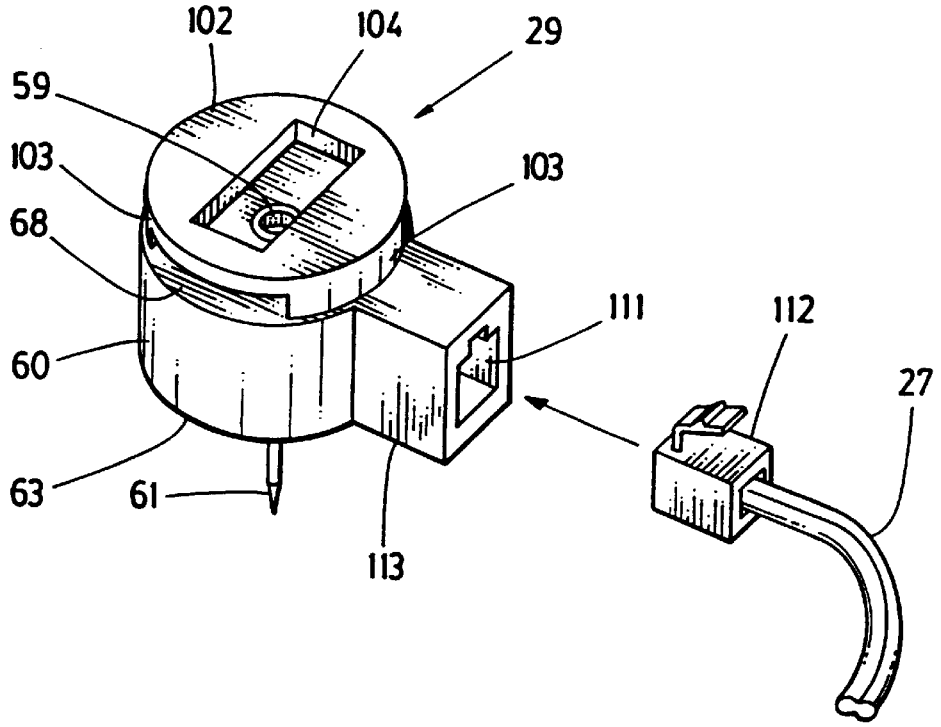
FIG. 10 is a perspective view of another embodiment of an electronic pin fastener of the present invention having a jack port for detachable connection of the garment pin cable.
Figure 11:
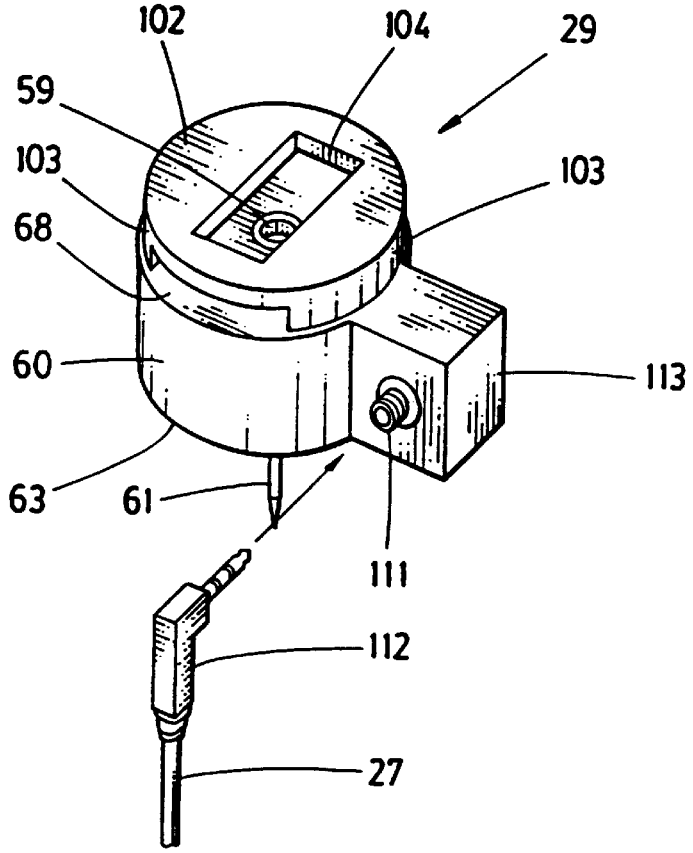
FIG. 11 shows another embodiment of the electronic pin fastener according to the present invention similar to FIG. 10 but having a different type of jack port for detachable connection of a garment pin cable.
Figure 12:
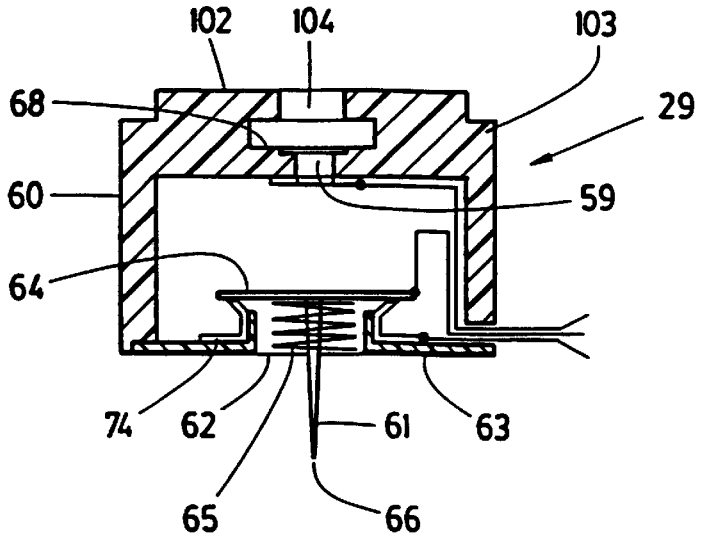
FIG. 12 illustrates schematically the connections and alarm contacts as well as the mechanical operations of an electronic pin fastener similar to FIG. 10 having a normally closed loop circuit and a spring release.
Figure 13:
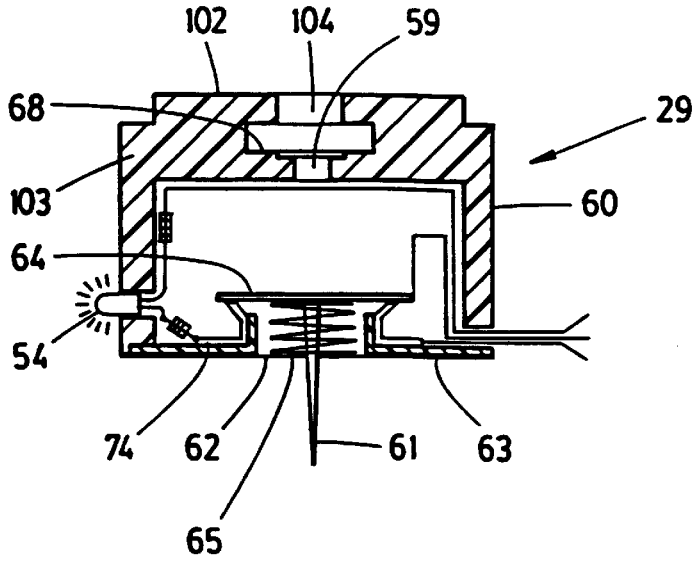
FIG. 13 illustrates schematically the connections and alarm contacts as well as the mechanical operations of the electronic pin fastener of FIG. 12 with an optional LED. alarm
Figure 14:
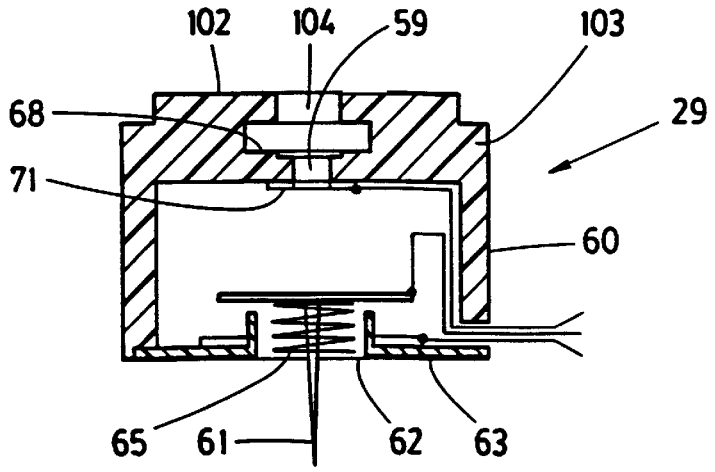
FIG. 14 illustrates schematically the connections and alarm contacts as well as the mechanical operations of an electronic pin fastener similar to FIG. 10 having a normally open loop circuit and a spring release.
Figure 15:
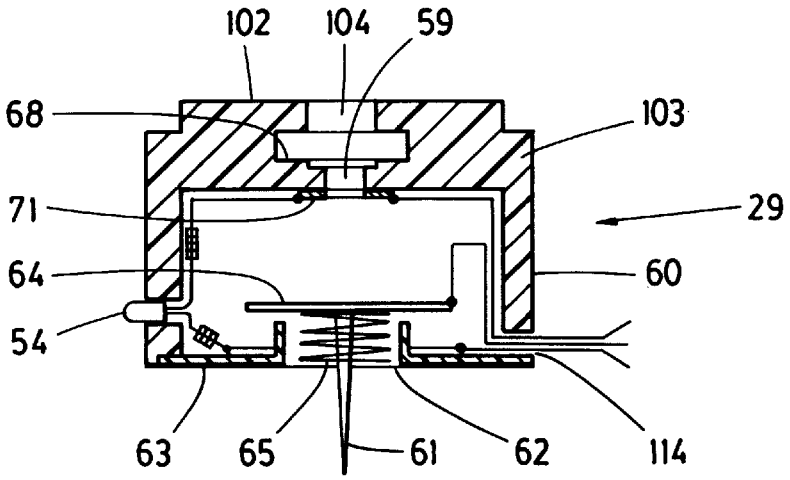
FIG. 15 illustrates schematically the connections and alarm contacts as well as the mechanical operations of the electronic pin fastener with an optional LED alarm.
Figure 16:
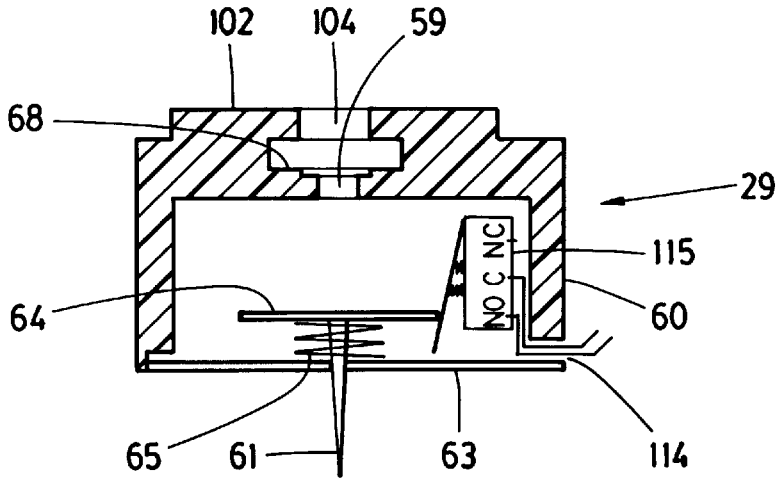
FIG. 16 illustrates schematically the connections and alarm contacts as well as the mechanical operations of an electronic pin fastener similar to FIG. 10 having a normally open loop with a c common micro switch.
Figure 17:
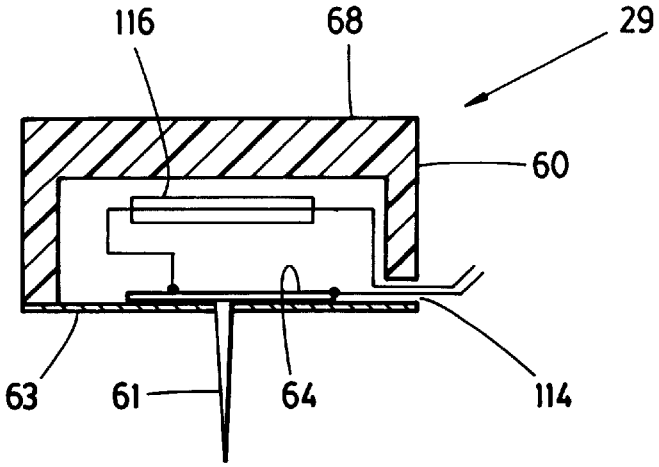
FIG. 17 illustrates schematically the connections and alarm contacts of an electronic pin fastener having a normally closed loop circuit and a magnetic reed switch.
Figure 18:
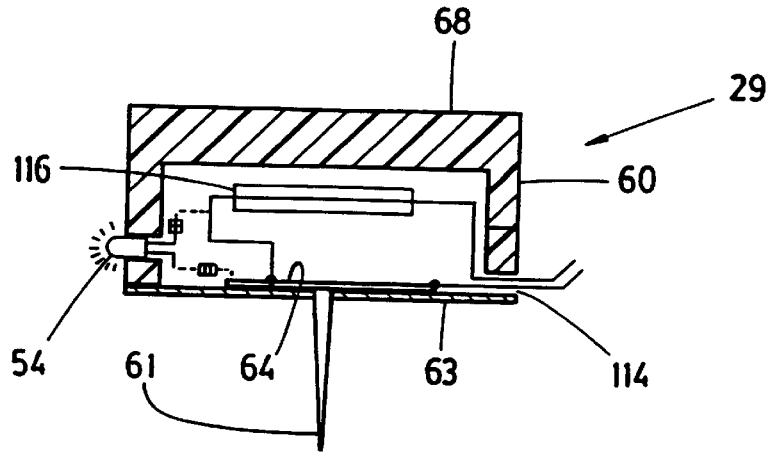
FIG. 18 illustrates schematically the connections and alarm contacts of an electronic pin fastener of FIG. 17 having an optional LED alarm.
Figure 19:
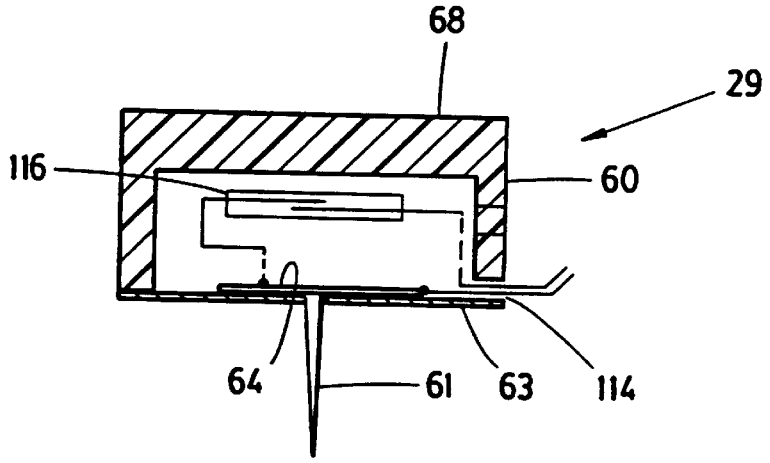
FIG. 19 illustrates schematically the connections and alarm contacts of an electronic pin fastener having a normally open loop circuit and a magnetic reed switch.
Figure 20:
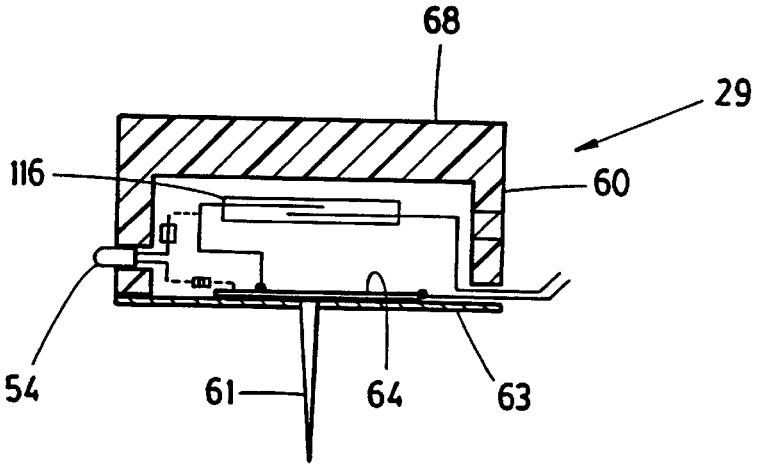
FIG. 20 illustrates schematically the connections and alarm contacts of an electronic pin fastener of FIG. 19 having an optional LED alarm.
Figure 21:
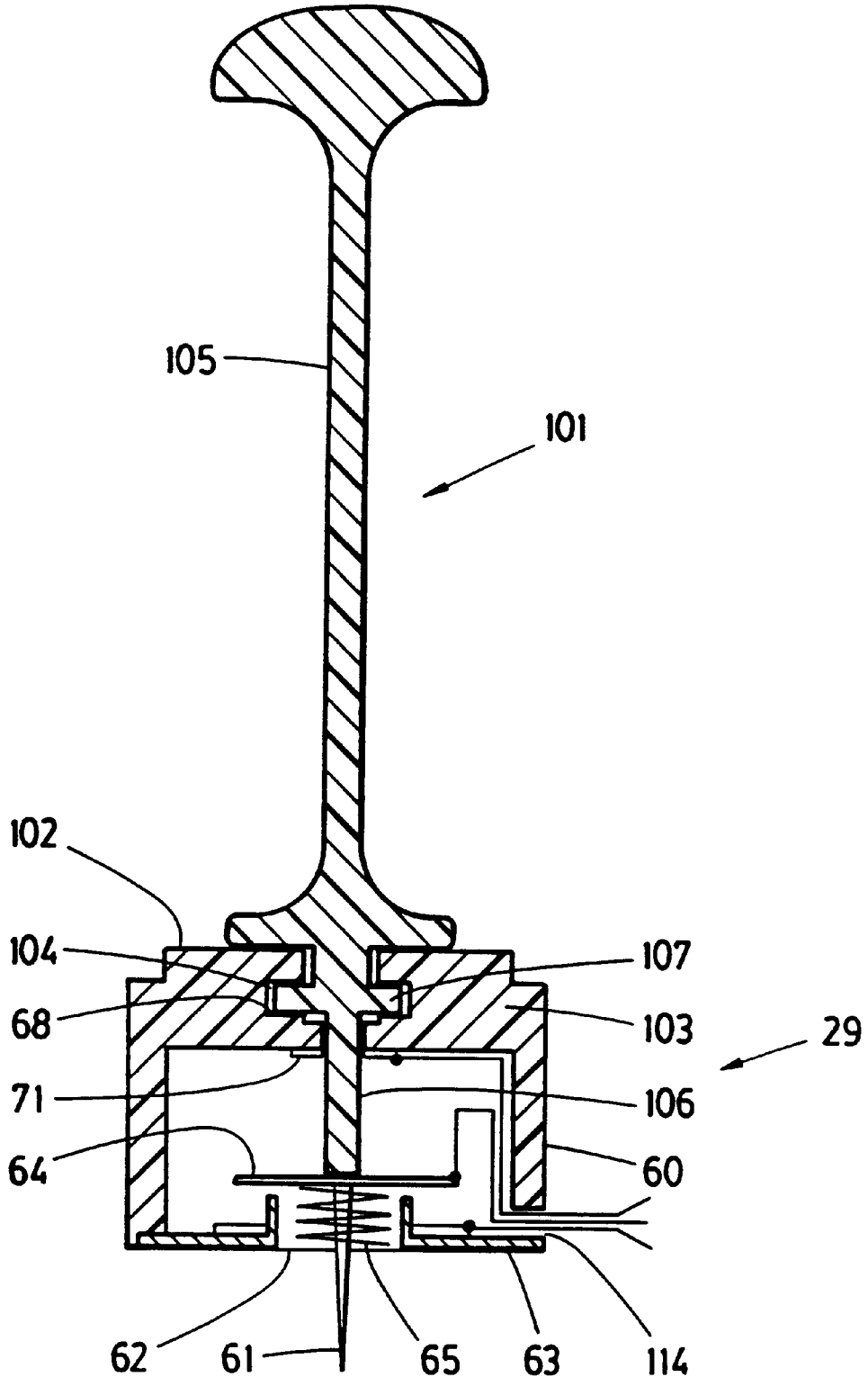
FIG. 21 is a cross section of the electronic pin fastener of FIG. 14 having a mechanical activation device latched into the pin fastener.
Figure 22:
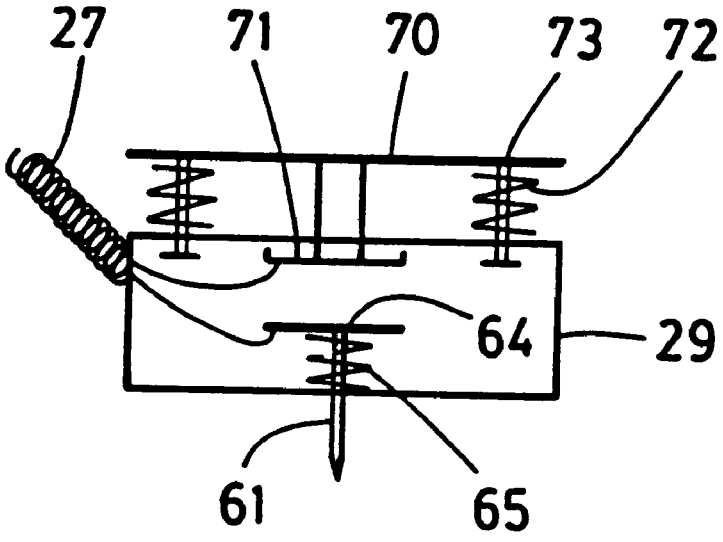
FIG. 22 illustrates schematically the connections and alarm contacts of an electronic pin fastener having a plunger activation mechanism.
Figure 23:
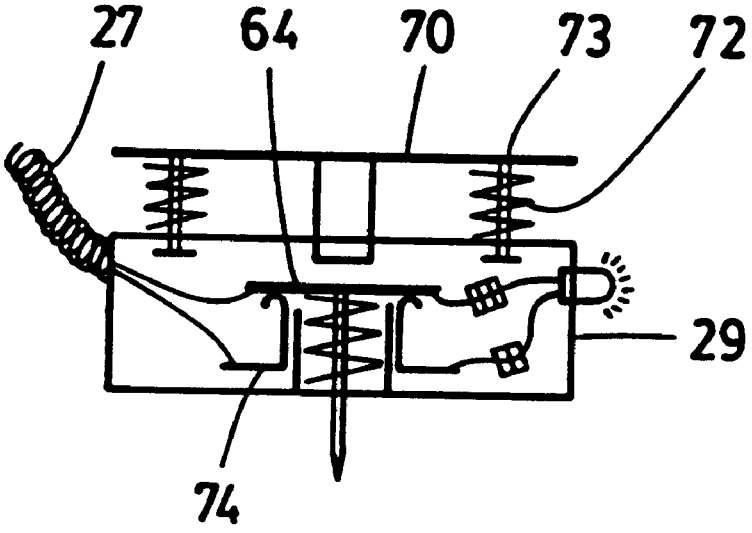
FIG. 23 illustrates schematically the connections and alarm contacts of another electronic pin fastener having a plunger activation mechanism.

The electronic pin fastener 29 as illustrated in FIG. 2 includes a housing 60 having a pin 61 extending through a hole 62 in the bottom 63 of the housing 60. The head 64 of pin 61 is spring biased against the inside of the bottom of the housing by spring 65. Tip 66 of the pin 61 that extends through the hole 62 is adapted to be depressed after insertion through a garment 17 and locked in position by an EAS tag or locking mechanism 11 as shown in FIG. 4. The means for retaining the pin 61 in the depressed position may be a spring release mechanism as currently used on Sensomatic EAS tags or with a clutch locking mechanism which are normally released by a magnetic pull. The electronic pin fastener 29 provides a solution to unwanted removal of existing EAS tags as well as a additional security working in conjunction with existing EAS security systems by providing not only primary protection when the garment pin cable or pin fastener is removed by an unauthorized individual by sounding of an alarm, but in conjunction with EAS a secondary backup alarm. The electronic pin fastener 29 can be electronically configured either in a normally open circuitry, (referred to as N.O.) as shown in FIGS. 3, 4, 14, 15, 16, 19, 20 and 21 or a normally closed circuitry, (referred to as N.C.) shown in FIGS. 12, 13, 18 and 18. The electronic pin fastener 29 is provided with means to permit said pin to be depressed. In FIGS. 4, 10 and 11 for example the means to permit the pin to be depressed includes a hole 59 in the top of the housing for depressing the pin 61 into the non-alarm position. Either a built in plunger 70 as shown in FIG. 3, 22 and 23 or mechanical operation using the pin setting tool of FIG. 7 can be utilized. An LED display 54 can be optionally provided to indicate an alarm condition. The mechanical operation for setting the electronic pin fastener units pin 61 is accomplished by the pin setting tool 57 (FIG. 7). This tool has one end 58 configured as a Phillips screw driver so that access to the battery case can be obtained by removal of screws not shown. To set the pin, the end of the pin setting tool means 57 is inserted into hole 59 and pressing pin 61 into a locked position of a EAS tag or locking device 11. The locking device or EAS tag 11 will hold the pin 61 in a normally open (N.O.) or normally closed (N.C.) position, depending on which circuitry is used, until the EAS tag or lock has been removed. On release of the lock or EAS tag the spring 65 will repel the head 64 of the pin to make contact on the normally open circuit or release the contact on the normally closed circuit causing an alarm. By incorporating a built in plunger 70 as illustrated in FIGS. 3 and 22 and 23 need for the pin setting tool 57 can be eliminated. Plunger 70 is mounted so that it will move through aperture 59 to push the pin 61 into position and is spring biased to return to its normal position. In FIG. 3 and FIG. 22 the pin fastener 29 uses a normally open circuit. Plunger 70 is formed of plastic or other non-conductive material so that when the head of the pin is depressed the alarm will not sound. A metal eyelet 71 or other conductive material is placed around aperture 59 to act as one contact. The other contact is the head 64 of pin 61. When the pin 61 is released from the locking mechanism 11, spring 65 will force the head of the pin into contact with eyelet 71 closing the circuit and sounding the alarm. The plunger 70 projects through aperture 59 and can be mounted on springs 72 and pins 73 at the edges of the top surface of the plunger 70 or with a spring located around the plunger. The plunger can be made of metal or other conductive material where it is the second contact. In FIG. 23, where the circuit is closed when the pin 61 is depressed, a contact ring 74 surrounds spring 65 to act as the second contact. When pin 61 is released from the locking device 11 the head 64 of the pin 61 is forced up to break the circuit and sound the alarm. Other methods of configuring the circuit in the electronic pin fastener are by means of a micro switch 115 with a lever type of setup (see FIG. 16) for the use with both spring and magnetic releases or a reed switch 116 (see FIGS. 17–20) for only magnetic release locks or EAS tags.

Another embodiment of pin fastener 29 is illustrated in FIGS. 10 to 16 and 21. The pin fastener 29 has a housing 60 having a pin 61 extending through a hole 62 in the bottom 63 of the housing 60. The head 64 of pin 61 is biased towards a non-depressed position to cause an alarm. The bias means is preferably a spring 65 pressing against the bottom of the housing as shown in FIGS. 12, 13, 14, 15, 16 and 21. Tip 66 of the pin 61 that extends through the hole 62 is adapted to be depressed and then inserted through a garment 17 and locked in position by an EAS tag or locking device 11 the same as shown in FIG. 4. The means for retaining the pin 61 in the depressed position may be a spring release mechanism as currently used on Sensomatic EAS tags or with a clutch locking mechanism which are normally released by a magnetic pull.

The electronic pin fastener 29 is provided with means to permit said pin to be depressed and maintained in the depressed position while the pin is inserted through the garment and inserted into the EAS tag or locking device. In FIGS. 10 and 11 for example the means to permit the pin to be depressed includes a hole 59 in the top 68 of the housing 60 and latch means to permit a pin setting tool 101 to be inserted into hole 59 to depress the pin 61 into the non-alarm position. The latch means preferably comprises a latch plate 102 supported above the top wall 68 of housing 60 on supports 103. A slot 104 is centrally disposed in latch plate 102 above aperture 59. The pin setting tool 101 (FIG. 21) preferably has a handle 105 and a co-axial depending stem 106 sized to fit through aperture 59 and depress pin 61 into the non-alarm position. Stem 106 is adapted to be latched into position to maintain the pin in the depressed non-alarm position until it can be inserted into the locking device 11. In the preferred embodiment shown in FIG. 21, the stem 106 is provided with a horizontal rectangular flange 107 slightly smaller than the slot 104 which is also preferably rectangular. After the stem 106 is inserted through slot 104 and aperture 59, flange 107 is positioned in the space between the top 68 of the housing and latch plate 102. The handle 105 of the pin setting tool 101 is then rotated 90 degrees so that flange 107 is latched under plate 102 thereby maintaining the pin in a depressed non-alarm position. After the pin is inserted into the locking device the handle 105 can be rotated to release flange 107 and the pin setting tool removed. In the preferred embodiment housing 60 and latch plate 102 and supports 103 are integrally molded as one piece. The bottom wall 63 of housing 60 is a separate insert to permit assembly of the components and is then glued or heat welded into position.

The garment pin cable 27 can be either be wired directly to pin fastener 29 or may have one end adapted to be detachably connected to pin fastener 29 as shown in FIGS. 10 and 11. In FIG. 10 and 11 a jack port 111 is provided and a plug of either of the configurations commonly used attached to the end of pin cable 27. Unauthorized removal of plugs 112 from jack ports 111 will cause an alarm to be sounded. To accommodated jack ports 111, housing 60 has been modified in FIGS. 10 and 11 by extension 113. Where the garment pin cable is connected directly to the pin fastener 29 it can be wired through a hole 114 in the side wall of the housing 60.

In the preferred embodiment, cables 23 and 27 are designed to provide a signal when cut or otherwise removed. A preferred cable is disclosed in previously identified U.S.

Pat. No. 4,620,182, the disclosure of which is also incorporated herein by reference. In that patent, the cable contains a pair of conductible elements, such as are included in coaxial cable such as COLUMBIA FLEX FOAM 1359, manufactured by Columbia Electronic Cables, of Pawtucket, R.I. As described in U.S. Pat. No. 4,620,182 any attempt to cut or otherwise remove the cables causes completion of an electronic circuit which then activates the alarm.

Thus, both alarm cable 23 and garment pin cables 27 will complete an electronic circuit when they are cut to notify the existence of a security condition. The system is connected to the alarm cable 23 and to the garment cables 27 via universal cable connector 25. Alarm box 21 includes a self setting digital access code located with the power source 51 shown in FIG. 9. Other features that may be incorporated into the alarm box 21 are instant and delayed alarm settings as well as a multiple pin junction for resetting a new access codes. Also, included for customer ease of use, is a functional LED light 52 for activate or inactivated states of the alarm box 21. Alarm box 21 may be configured with either normally open or normally closed circuitry so long as it is the same configuration used with the electronic pin fastener.

The connection of the alarm cable 23 and the garment cables 27 to the cable connector 25 is by a common jack and plug arrangement similar to plug 33 and jack 35 on the alarm box. The cable connector 25 has a plurality of jacks 41 connected to each other and to any element inserted into the jacks 41. Plug 43 on alarm cable 23 is inserted into one of end jacks 41, thereby connecting the cable connector means 25 to the alarm box 21. Each garment cable 27 includes a plug 47 which also connects the individual cables to the alarm box via cable connector 25. It is unnecessary to provide a cover on the cable connector 25 to prevent tampering. Due to the completion of all connections any removal of any of the plugs 47, 43 or 33 would activate an alarm.

In a preferred embodiment, the cable connector 25 is attached to a multitude of fixtures, racks and bins by bracket means 50 without the elimination or removal of any existing part of the fixture 9, thus, eliminating the expense of disposal of excess parts. The bracket 50, as shown in FIG. 8, has a sliding locking lower plate 81 which has a generally S-shape. This lower plate 81 in conjunction with an upper L-shaped plate 82 permits adjustment to various fixture thicknesses and styles as well as potential slot wall application, not mentioned previously.

In operation, a plurality of garment cables 27 are attached via electronic pin fastener 29 to garments 17. Persons interested in examining a garment or trying it on can do so without having to remove the electronic pin fastener 29 from the garment. In a preferred embodiment, garment cables 27 are long enough and/or are coiled with high memory coils to permit the potential customer to move to a mirror or model the garment for those who are accompanying the shopper. Any attempt to cut garment cables 27, 23 or removal of plugs 33 or 47 as well as the electronic pin fastener 29, EAS tag or locking device 11 will cause a circuit to be completed or opened, as described previously, and the alarm box 21 will sound an alarm.

Once the customer has decided to purchase one or more garments from the display fixture, the sales clerk using key pad 37 then selects the delayed alarm setting, removes plug 47 for the selected items from the cable connector and then enters a pre-selected digital code on key pad 37 within 12–15 seconds, creating no alarm. On completion of their digital access the system will fully reactivate instantly to protect the remaining items, without any additional sales staff assistance. In instances where EAS is used in conjunction with the electronic pin fastener the alarm from the EAS tag will protect the item from exiting the store without being disarmed but all the benefits of the security system 10 will not be realized. On purchase of the merchandise the sales clerk would then remove the EAS tag 11 with the appropriate tool for that tag, as well as the electronic pin fastener 29 causing no alarm. If an EAS tag is not used in conjunction with the electronic pin fastener, but rather a standard locking mechanism not withstanding multiple locking mechanism can be used, the sales clerk would take the merchandise into custody till payment had been rendered at which point removal of the electronic pin fastener 29 would occur. If an EAS tag is not used in conjunction with the electronic pin fastener the benefits of a secondary alarm system will not exist. In either case, the customer will be able to pay for and take home the garment of choice without disturbing the alarm system. Unlike other systems the sales clerk is not required to re-arm the system after removal of the desired garment as the system win automatically be reactivated to the on or operating condition after keying in the digital code so that all of the remaining garments are secure.

The system described herein is adapted to prevent loss of goods by sounding an alarm. Accordingly, cutting or the unauthorized removal of any of the cables 27 or 23 or the electronic pin fastener 29 will sound an alarm. The cable connector 25 preferably includes two or three tracks of conductivity, which are separated by insulation or spacing in a normal operating condition. Jacks 41 and plugs 43 and 47 operate on the principle of keeping the two or three tracks of conductivity separated. If the third track is utilized the main purpose would be to power the optional LED light 54 on the electronic pin fastener 29. Thus, when a cable is cut, the circuit is completed and will sound the alarm and activate LED 54 if that option is selected. Also, as a plug is removed from a jack, a temporary condition of complete circuit exists, again causing the alarm to be sounded. As noted previously this system permits interaction with other systems forming a primary and a secondary backup solving existing problems with EAS and locking mechanisms unique only to this system and the electronic pin fasteners.

Having illustrated and described preferred embodiments of the invention and certain possible modifications thereto, it should be apparent to those of ordinary skill in the art that the invention permits of further modification in arrangement and detail.

It will be appreciated that the above description related to the preferred embodiment by way of example only. Many variations on the invention will be obvious to those knowledgeable in the field, and such obvious variations are within the scope of the invention as described and claimed, whether or not expressly described.

I claim:

1. An electronic pin fastener for use in a security system for garments, merchandise and the like mounted for sale or display on a display fixture, rack or bin whereby removal of the electronic pin fastener will cause an alarm, said electronic pin fastener comprising: an enclosed housing having top and bottom walls, an aperture central disposed in said top wall, a hole centrally disposed in said bottom wall, a pin having a head and a stem, the stem of the pin extending through said hole in said bottom wall and bias means adapted so that the head of said pin is biased towards a position such as to cause an alarm, said stem of the pin adapted to be retained in a depressed non-alarm position by an EAS tag or locking mechanism after the pin is inserted through a garment, merchandise or the like wherein said locking mechanism includes a spring release mechanism or a clutch locking mechanism.

2. An electronic pin fastener according to claim 1 wherein said electronic pin fastener includes a micro switch with lever.

3. An electronic pin fastener according to claim 1 further comprising latch means for retaining said pin in a depressed non-alarm position so that the stem of the pin can be inserted into the garment, merchandise or the like and retained in said depressed position by said locking mechanism.

4. An electronic pin fastener according to claim 3 wherein said latch means comprises a latch plate supported above the top wall of the housing and a slot centrally disposed in said latch plate and a locking tool adapted to be inserted through said slot and the aperture in the top wall of the housing to depress the head of the pin said tool being rotatable when inserted through said slot to a locked position thereby retaining the pin in the depressed position.

5. An electronic pin fastener for use in a security system for garments, merchandise and the like mounted for sale or display on a display fixture, rack or bin whereby removal of the electronic pin fastener will cause an alarm, said electronic pin fastener comprising: an enclosed housing having top and bottom walls, an aperture centrally disposed in said ton wall, a hole centrally disposed in said bottom wall, a pin having a head and a stem, the stem of the pin extending through said bole in said bottom wall and bias means adapted so that the head of said pin is biased towards a position such as to cause an alarm, said stern of the pin adapted to be retained in a depressed non-alarm position by an EAS tag or locking mechanism after the pin is inserted through a garment, merchandise or the like including a means for detachable connection of the pin fastener to the system.

6. An electronic pin fastener according to claim 5 wherein said means for detachable connection to the system includes a jack in said housing for receiving a matching plug on a cable connected to said system.

* * * * *